US006295752B1

(12) United States Patent
Havlock

(10) Patent No.: US 6,295,752 B1
(45) Date of Patent: Oct. 2, 2001

(54) PROJECTILE GUIDE

(75) Inventor: Christopher Havlock, Kalamazoo, MI (US)

(73) Assignee: Crossfire, Inc., Kalamazoo, MI (US)

( * ) Notice: Subject to any disclaimer, the term of this patent is extended or adjusted under 35 U.S.C. 154(b) by 0 days.

(21) Appl. No.: 09/406,118

(22) Filed: Sep. 27, 1999

(51) Int. Cl.[7] ..... F41A 21/18

(52) U.S. Cl. ..... 42/76.01; 42/106; 89/14.05; 124/83; 124/71

(58) Field of Search ..... 124/56, 83; 42/63, 42/76.01, 76.02, 77, 78; 89/14.05, 14.1–14.6

(56) References Cited

U.S. PATENT DOCUMENTS 32,685 * 7/1861 DeBrame .
D. 288,104 * 2/1987 Barthropp .
D. 353,853 * 12/1994 Albritton .
D. 435,884 * 1/2001 Dehaan .
855,439 * 6/1907 Adrianson .
2,340,821 * 2/1944 Russell .
2,870,679 * 1/1959 Collins .
3,288,127 11/1966 Bullock .
4,570,529 * 2/1986 A'Costa .
4,757,741 * 7/1988 Brothers .
5,005,463 * 4/1991 A'Costa .
5,214,234 * 5/1993 Divecha et al. .
5,228,427 7/1993 Gardner, Jr. .
5,249,385 * 10/1993 Vang et al. .

* cited by examiner

*Primary Examiner*—Peter M. Poon
*Assistant Examiner*—Troy Chambers
(74) *Attorney, Agent, or Firm*—Flynn, Thiel, Boutell & Tanis, P.C.

(57) ABSTRACT

A projectile guide for a compressed gas powered gun which includes a hollow cylindrical sleeve-like base with an axially extending projectile guiding cylindrical opening therethrough. The base has at one end thereof and extending axially from this one end a plurality of elongate and circumferentially spaced members of finite length and configured relative to each other to define a projectile guiding passageway for a projectile fired from the gun.

16 Claims, 4 Drawing Sheets

PROJECTILE GUIDE

FIELD OF THE INVENTION

This invention relates to a projectile guide for a compressed gas powered gun and, more particularly, to a barrel adapted for use in a paintball gun.

BACKGROUND OF THE INVENTION

Projectile guides for compressed gas powered guns are usually an elongate solid member with a cylindrical bore therethrough. These projectile guides, commonly referred to as barrels, are usually removably secured to the body of the compressed gas powered gun. Oftentimes, and when the aforementioned barrels are used in a paintball environment, the paintballs break inside the barrel and coat the interior surface thereof with the gelatinous material (paint) and, after a while, the projectiles travelling through the hollow interior of the barrel are affected by the gelatinous material (paint) to cause the projectile to move erratically after exiting the outlet end of the barrel. It is thus necessary to squeegee the gelatinous material (paint) off from the interior walls of the bore of the barrel. Thus, there exists a desire for barrels which are much less sensitive to the breakage of gelatinous material (paint) containing projectiles while travelling inside a barrel.

Accordingly, it is an object of the invention to provide a projectile guide for a compressed gas powered gun wherein the projectile guide includes a hollow cylindrical sleeve-like base with an axially extending projectile guiding cylindrical opening therethrough, the base having at one end thereof and extending axially from this end a plurality of elongate and circumferentially spaced members of a finite length and configured relative to each other to define a projectile guiding passageway for a projectile fired from the aforesaid gun.

It is a further object of the invention to provide a barrel for a compressed gas powered gun, as aforesaid, wherein at least one annular ring is provided along the length of the members and being connected to the members so as to maintain the circumferential spacing fixed along the length of the barrel.

It is a further object of the invention to provide a projectile guide, as aforesaid, wherein a radially innermost portion of an exterior surface of each of the members lies substantially tangent to both of the radially inwardly facing surface of the cylindrical opening through the base and a second radially inwardly facing surface of each of the annular rings.

It is a further object of the invention to provide a projectile guide, as aforesaid, wherein a radially innermost portion of the exterior surface of each of the members lies radially inwardly of both of a first radially inwardly facing surface of the cylindrical opening through the base and a second radially inwardly facing surface of each of the annular rings.

It is a further object of the invention to provide a projectile guide, as aforesaid, wherein circumferentially spaced elongate gaps are provided along the length of the projectile guide to provide air communication between the interior portion of the projectile guide and the exterior portion thereof.

SUMMARY OF THE INVENTION

The objects and purposes of the invention are met by providing a projectile guide for a compressed gas powered gun which includes a hollow cylindrical sleeve-like base with an axially extending projectile guiding cylindrical opening therethrough. The base has at a first end thereof and extending axially from the first end a plurality of elongate and circumferentially spaced members of finite length and configured relative to each other to define a projectile guiding passageway for a projectile fired from the gun.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
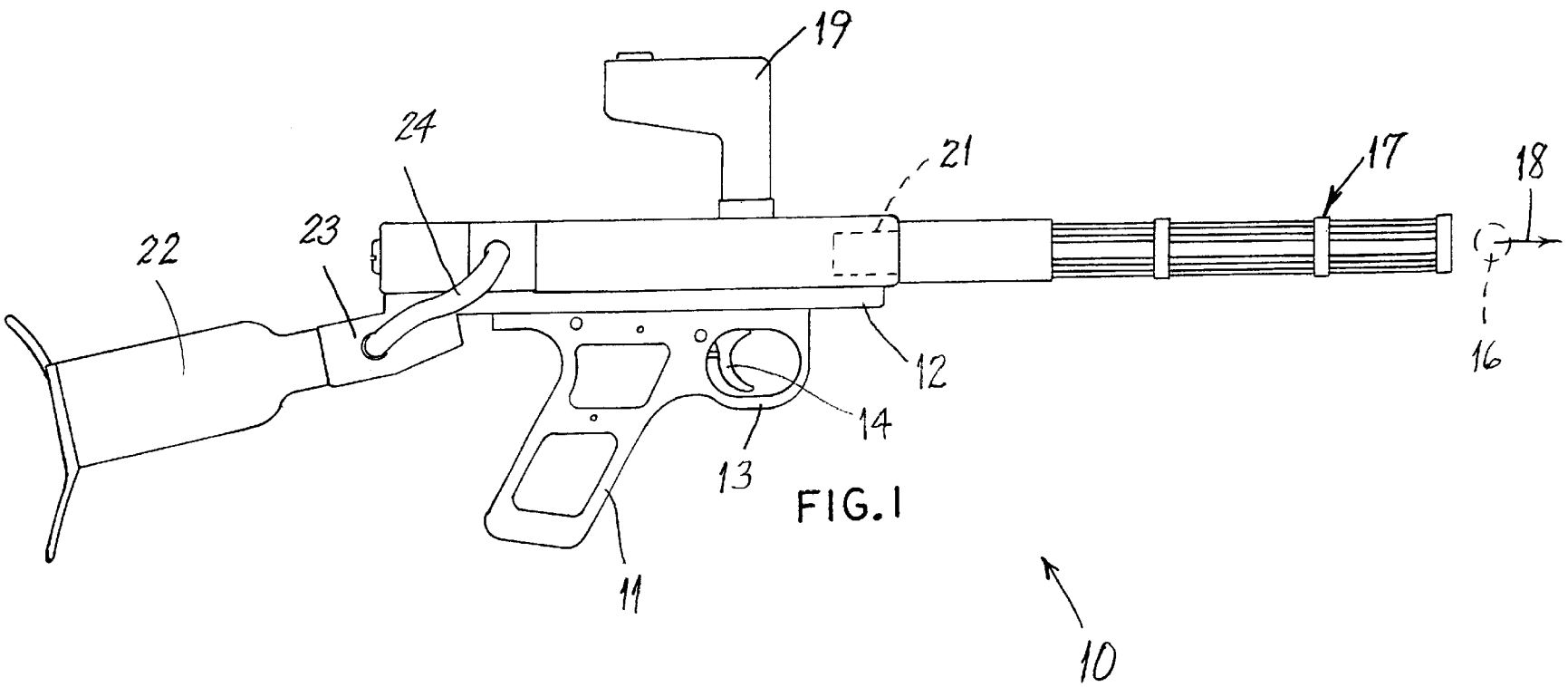
FIG. 1 is a side elevational view of a compressed gas powered gun with a projectile guide embodying the invention thereon.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

The compressed gas powered gun 10 illustrated in FIG. 1 may be used as a marking or paintball gun used for propelling gelatinous capsules of the kind used for "marking" a target. As is common with conventional weaponry, the gun 10 includes a frame support member or body 11 which supports a handle 12 and a trigger guard 13. A pivotally mounted trigger 14 is disposed within the trigger guard 13. As hereinafter is explained, a projectile 16, such as a marking pellet, exits an elongated projectile guide, namely, a barrel 17, in the direction of the arrow 18 during a firing operation. An ammunition receptacle 19 houses a plurality of projectiles to supply the gun 10 as will be readily understood to those skilled in the art. The inventive projectile guide or barrel 17 is connected to the body 11 of the gun 10 by any conventional means, hereby a threaded connection 21. A cartridge or canister 22 of the type well known to those skilled in the art contains a compressed gas to supply compressed gas for discharging the projectile 16 from the gun 10. The compressed gas cartridge 22 screws into a known type of air tank adapter 23 threadedly mounted to the body 12. The compressed gas contained in the cartridge 22 passes from the air cartridge adapter 23 via an enclosed inlet passageway 24 and is thereafter supplied to a compressed gas delivery system which includes a pressure regulating assembly via an enclosed air passageway. The compressed gas cartridge can, in the alternative, be carried in a backpack carried on the back of the user. In this instance, a hose connection from the backpack oriented cartridge to the gun body 12 will be provided. All of the aforesaid structure associated with the cartridge and the structure for delivering the compressed gas to the firing chamber is well known in the art and is, therefore, not discussed in further detail in this disclosure.

Turning now to the construction of the inventive projectile guide or barrel 17, it includes a hollow cylindrical sleeve-like base 26 having an axially extending projectile guiding cylindrical opening or bore 27 extending therethrough. In this embodiment, the base 26 also has at one end thereof a reduced diameter section 28 having on the exterior surface thereof an externally threaded section 29. This reduced diameter section 28 and the externally threaded section 29 thereon is adapted to be received into a correspondingly sized receptacle in the body 12 of the gun 10 so as to facilitate a threaded connection as at 21 of the projectile guide 17 to the body 12 of the gun 10. It is, of course, to be recognized that the base 26 can also be integrally formed as part of the gun body 12.

Figures 2, 3, 4, 5:
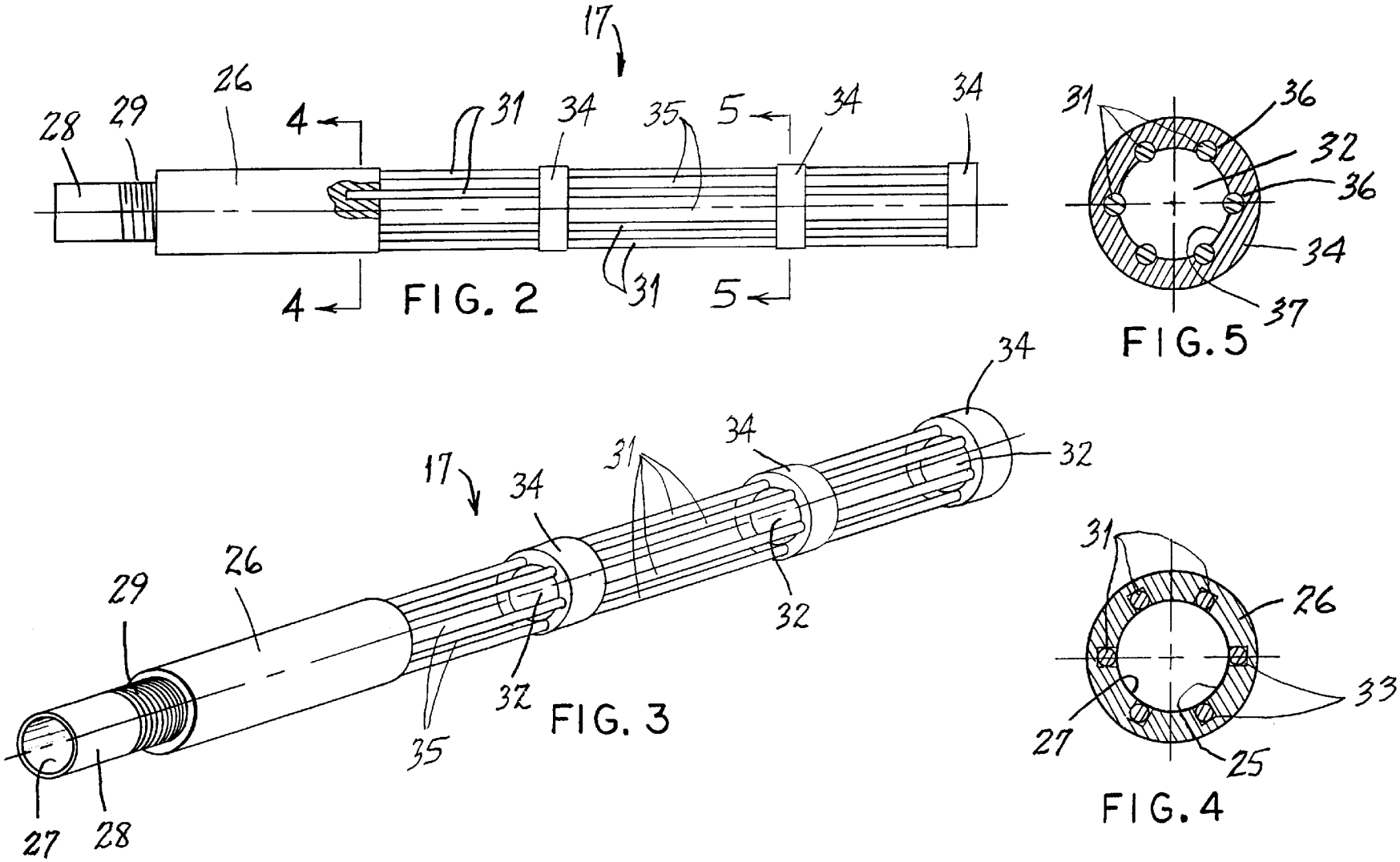
FIG. 2 is a side elevational view of the projectile guide embodying the invention.
FIG. 3 is an isometric view of the aforesaid projectile guide.
FIG. 4 is a sectional view taken along the line 4—4 of FIG. 2.
FIG. 5 is a sectional view taken along the line 5—5 of FIG. 2.

Extending axially from a second end of the base 26 is a plurality of elongate and circumferentially spaced members 31, each having a finite length and each being configured relative to each other to define a projectile guiding passageway 32 for the projectile 16 fired from the gun 10. In this particular embodiment, and as is illustrated in FIG. 4, the elongate members 31 are each received into an elongate recess or groove 33 provided on the interior surface of the bore 27 in the base 26. The ends of the members 31 proximate the base 26 and received in the grooves 33 are secured therein by any convenient means, such as solder, welding or the like. The radially innermost part of the exterior surface of each of the members 31 located inside the bore 27 of the base 26 are preferably tangent to a theoretical axial extension of a cylinder defined by a surface 25 of the bore 27 of the hollow cylindrical sleeve-like base 26. As the members 31 transition rightwardly from the proximal end located inside the bore 27, the radially innermost portion of each of the members 31 lie radially inwardly of the theoretical axial extension of the cylinder defined by the surface 25 of the bore 27.

In the illustrated embodiment, the elongate members 31 are each cylindrical rods and each of the rods extend axially from the base 26 in a circumferentially spaced relation. A plurality of annular rings 34 are axially spaced along the length of the projectile guide 17. In this particular embodiment, grooves 36 are provided on the interior surface 37 of each of the rings 34 and are adapted to receive therein the elongate members 31. Conventional fastening is provided to secure the rings 34 to the members 31, such as by soldering or welding. In this particular embodiment, the radially innermost portion of each of the members 31 lies radially inwardly of a theoretical axial extension of a cylinder defined by the interior surface 37 of each of the annular rings 34. As a result of the aforesaid structure, gelatinous material (paint) containing projectiles 16 can move from the end of the base 26 whereat the gun body 12 and/or the threaded section 29 is located toward the opposite end thereof and out through the passageway 32 defined by the circumferentially spaced members 31 without tearing the gelatinous material (paint) containing projectile at the point where the members 31 terminate inside the bore 27 in the base 26. Further, the annular ring 34 provided at the distal end remote from the base 26 serves to protect the ends of the members 31 from damage during rough usage thereof. Further, if a gelatinous material (paint) containing projectile happens to break while it is inside the projectile guide 17, the gelatinous material (paint) will exit through the spaces 35 between the elongate members 31 thereby making it unnecessary to stop play and clean the inside of the barrel at frequent intervals. Furthermore, air will be permitted to move ahead of the projectile as well as behind the projectile to cause the projectile to exit the projectile guide 17 in a more accurate trajectory.

Figure 6:
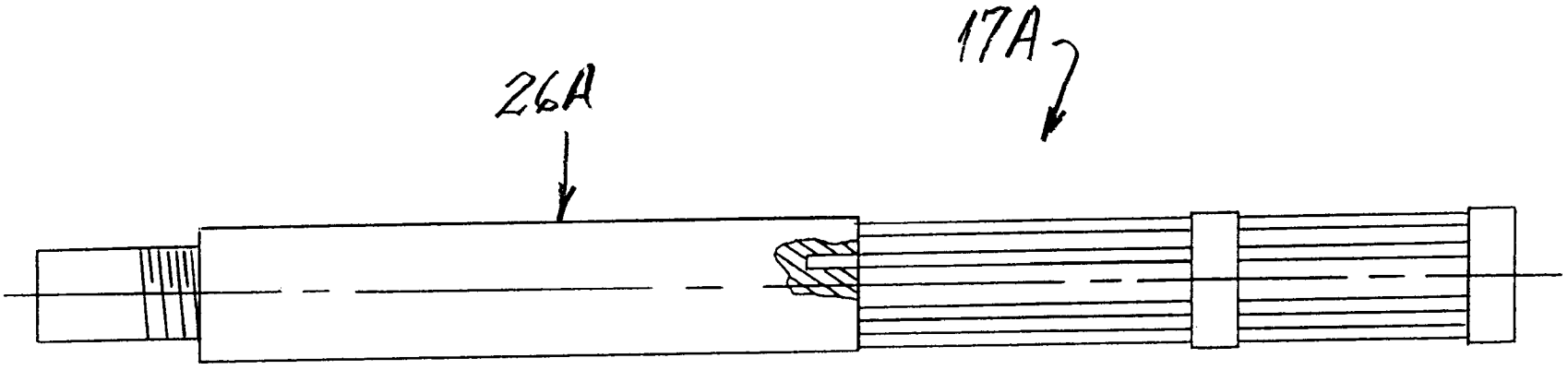
FIG. 6 is a side elevational view of a modified projectile guide embodying the invention.
Figure 7:
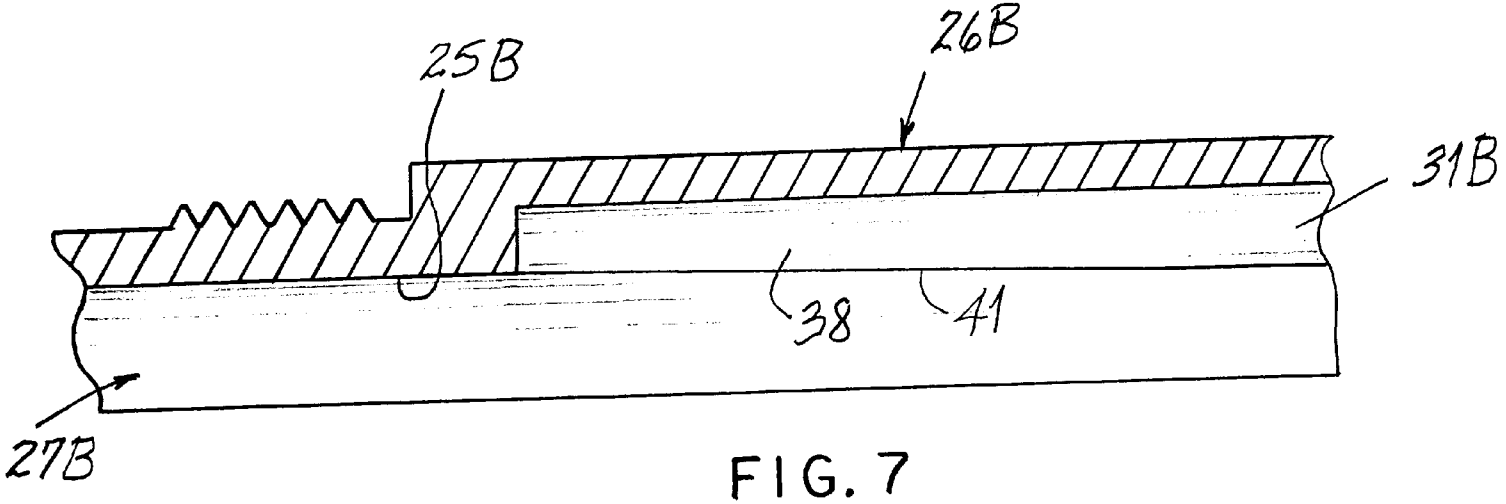
FIG. 7 is an enlarged fragmentary sectional view of a modified base portion of the projectile guide.
Figure 8:
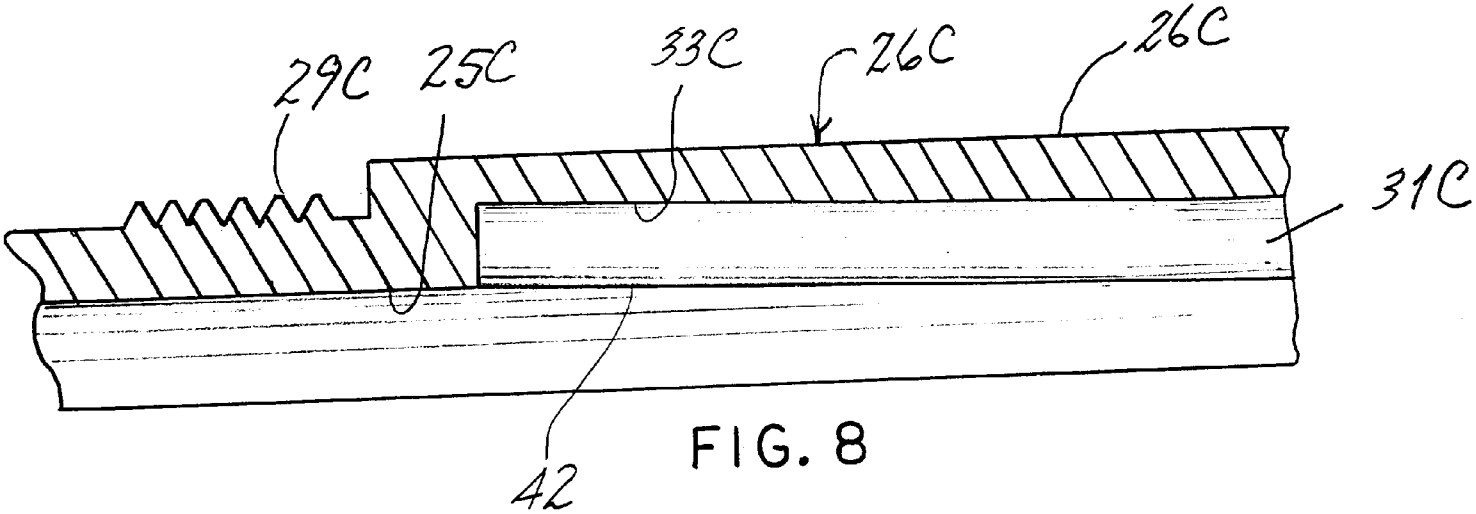
FIG. 8 is a modification of the embodiment illustrated in FIG. 7.

In the embodiments of FIGS. 6–8, the letters "A", "B" and "C" have been used as a suffix to a reference number designating a component described above. The designated reference numeral and accompanying suffice indicate that the component structure described above is incorporated into the described embodiment to thereby make it unnecessary to describe the component structure in any further detail.

As is illustrated in FIG. 6, a modified projectile guide 17A is illustrated which has a longer hollow cylindrical sleeve-like base 26A than is illustrated in FIGS. 2 and 3. Other than this distinction, the projectile guide 17A is constructed in a like manner to the construction described above with respect to FIGS. 2–5. Accordingly, further comment in regard to the modified projectile guide 17A is believed unnecessary.

FIG. 7 illustrates a modified base 26B wherein the elongate members 31B are machined at the proximal end 38 thereof located inside of the base 26B so as to provide a smooth transition between the interior surface 25B of the bore 27B. In other words, the proximal ends 38 of each of the members 31B is tapered as at 41 to provide a smooth transition from the interior surface 25B to the tapered surface 41 to prevent tearing of a gelatinous material (paint) containing projectile as it moves from left to right along the length of the bore 27B of the base 26B. In the alternative, and as is illustrated in FIG. 8, the grooves 33C provided in the surface 25C of a further modified base 26C can be machined to a deeper depth adjacent the threaded section 29C so that the elongate members 31C need only be bent so as to conform to the depth of the groove 33C to facilitate the smooth transition from the interior surface 25C to the radially inwardly most surface 42 of each of the elongate members 31C.

Embraced within this disclosure is an embodiment wherein the components of the inventive barrel are integral. That is, the inventive barrel is of a single piece construction as would be accomplished by a molding process. Also embraced within this disclosure is a single piece gun body and inventive barrel.

It is, of course, recognized that the elongate members 31, 31B and 31C can, instead, each be provided with an external thread at the end thereof adjacent the base 26 and a plurality of internally threaded tapped holes be provided in the end face of the base facing the elongate members. In this embodiment, each of the elongate members 31 would be threadedly secured to the base 26.

In operation, and with the projectile guide 17 properly secured to the body 12 of the gun 10, it has been observed that the projectiles 16 exiting the distal end of the projectile guide 17 travel in a much more accurate trajectory unaffected by previous breakages of gelatinous material (paint) containing projectiles while oriented inside the projectile guide 17.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A barrel for a compressed gas powered gun, comprising:

a hollow cylindrical sleeve-like base with an axially extending projectile guiding cylindrical opening therethrough, said base having at a first end thereof and extending axially from said first end a plurality of elongate and circumferentially spaced members of finite length and configured relative to each other to define a projectile guiding passageway for a projectile fired from said gun, said cylindrical opening through said base defining a radially inwardly facing cylindrical surface, said surface having a plurality of circumferentially spaced, longitudinally extending grooves therein corresponding in number and circumferential spacing to a number and spacing of said members and into each groove is received and secured one end of each said member.

2. The barrel according to claim 1, wherein a radially innermost portion of an exterior surface of each member lies substantially tangent to a theoretical axial extension of a cylinder defined by said radially inwardly facing cylindrical surface of said hollow cylindrical sleeve-like base.

3. The barrel according to claim 1, wherein a radially innermost portion of an exterior surface of each member lies radially inwardly of a theoretical axial extension of a cylinder defined by said radially inwardly facing cylindrical surface of said hollow cylindrical sleeve-like base adjacent said first end.

4. The barrel according to claim 1, wherein at least one annular ring is provided along the length of said members and being connected to said members so as to maintain said circumferential spacing fixed along the length of said barrel.

5. The barrel according to claim 4, wherein a radially innermost portion of an exterior surface of each member lies substantially tangent to a theoretical axial extension of a cylinder defined by said radially inwardly facing cylindrical surface of said hollow cylindrical sleeve-like base at a location remote from said first end whereat each groove terminates inside said cylindrical opening.

6. The barrel according to claim 1, wherein said members are cylindrical rods which extend parallel to each other.

7. The barrel according to claim 6, wherein said members are cylindrical rods which extend straight.

8. The barrel according to claim 1, wherein a plurality of coaxially spaced annular rings are provided along the length of said members with each thereof being connected to said members so as to maintain said circumferential spacing fixed along the length of said barrel.

9. The barrel according to claim 8, wherein a radially innermost portion of an exterior surface of each member lies substantially tangent to both of a first radially inwardly facing surface of said cylindrical opening through said base and a second radially inwardly facing surface of each of said annular rings.

10. The barrel according to claim 8, wherein a radially innermost portion of an exterior surface of each member lies radially inwardly of both of a first radially inwardly facing surface of said cylindrical opening through said base and a second radially inwardly facing surface of each of said annular rings.

11. The barrel according to claim 1, wherein each of said members terminate at a region defining an end of said barrel remote from said body and whereat an annular ring is provided for securing the terminal ends of said members so as to maintain said circumferential spacing fixed.

12. The barrel according to claim 1, wherein said grooves extend longitudinally of said base over a majority of a length of said base.

13. The barrel according to claim 1, wherein the circumferential spacing between said members provides open communication between the interior and exterior portions of said projectile guide.

14. The barrel according to claim 1, wherein a radially innermost portion of an exterior surface of a proximal end portion of each member lies substantially tangent to said radially inwardly facing cylindrical surface of said hollow cylindrical sleeve-like base while said radially innermost portion of said exterior surface of each member adjacent said first end of said base lies radially inwardly of said radially inwardly facing cylindrical surface.

15. The barrel according to claim 14, wherein at least one annular ring is provided along the length of said members and being connected to said members so as to maintain said circumferential spacing fixed along the length of said barrel.

16. The barrel according to claim 15, wherein said radially innermost portion of an exterior surface of each member adjacent said annular ring lies radially inwardly of a radially inwardly facing surface of said annular ring.

* * * * *